US005988426A

United States Patent [19]

Stern

[11] Patent Number: 5,988,426

[45] Date of Patent: Nov. 23, 1999

[54] LEAKPROOF VENTED BEVERAGE LID

[76] Inventor: Brett Stern, 255 W. 23rd St. (6A East), New York, N.Y. 10011

[21] Appl. No.: 09/044,954

[22] Filed: Mar. 20, 1998

Related U.S. Application Data

[63] Continuation-in-part of application No. 08/745,628, Nov. 8, 1996, abandoned.

[51] Int. Cl.[6] ..... B65D 51/16

[52] U.S. Cl. ..... 220/371; 220/780; 220/792; 220/796; 215/261

[58] Field of Search ..... 220/371, 780, 220/781, 784, 792, 796; 215/260, 261, 317

[56] References Cited

U.S. PATENT DOCUMENTS

| | | | |
|---|---|---|---|
| 3,326,401 | 6/1967 | De Long | 215/261 X |
| 3,696,958 | 10/1972 | Lee | 215/261 |
| 4,271,973 | 6/1981 | Quagliaro et al. | 215/308 |
| 4,765,499 | 8/1988 | Von Reis et al. | 215/261 |
| 4,863,051 | 9/1989 | Eibner et al. | 215/261 |
| 4,934,545 | 6/1990 | Pezzoli et al. | 215/250 |
| 4,935,371 | 6/1990 | Rickloff | 215/261 X |
| 4,953,743 | 9/1990 | Dart et al. | 220/369 |
| 5,391,496 | 2/1995 | Kayal et al. | 215/308 X |
| 5,407,087 | 4/1995 | Giblin et al. | 215/260 |
| 5,523,236 | 6/1996 | Nuzzo | 215/261 X |

FOREIGN PATENT DOCUMENTS

| | | | |
|---|---|---|---|
| 1295468 | 5/1969 | Germany | 215/261 |
| 2605694 | 8/1977 | Germany | 215/261 |
| 1174332 | 8/1985 | U.S.S.R. | 215/261 |

*Primary Examiner*—Stephen K. Cronin
*Attorney, Agent, or Firm*—Oblon, Spivak, McClelland, Maier & Neustadt, P.C.

[57] ABSTRACT

A disposable plastic lid is formed with a vent hole. A filter formed of a hydrophobic material such as polytetrafluoraethylene is mounted over the vent hole. The pore size of the filter material is selected to allow for the free passage of air and to inhibit or block the passage of liquids such as water.

26 Claims, 2 Drawing Sheets

LEAKPROOF VENTED BEVERAGE LID

This application is a continuation-in-part of U.S. patent application Ser. No. 08/745,628, filed Nov. 8, 1996, and entitled "Leakproof Vented Beverage Lid now abandoned."

BACKGROUND OF THE INVENTION

1. Field of the Invention

The present invention relates in general to a lid or cover for a container and relates in particular to a vented, water-tight plastic lid of the type commonly used to cover and seal beverage containers such as disposable coffee cups.

2. Description of Prior Developments

Disposable lids for food and drink containers are typically vacuum formed from a thin sheet of thermoplastic material such as styrene plastic. Radiant heat is applied to soften the plastic material as a vacuum draws the material over one or more lid molds. When cooled, the lids are trimmed, die cut and vented. A punch is used to puncture a vent hole of about 0.020 inch in the top central region of each lid.

Such container lids or covers have been in use for many years and are commonly used to cover paper or plastic containers such as hot and cold disposable beverage cups, as well as disposable food containers such as soup bowls and the like. Although these lids generally perform satisfactorily, a long-standing leakage problem has been associated with the presence of venting holes. That is, beverage lids are typically formed with a small puncture hole for allowing communication between the ambient atmosphere and a volume of air trapped between the top surface of the liquid (or other material held within the container) and the interior or underside of the lid.

This venting and communication between the interior of the lidded container and the outside ambient atmosphere prevents the formation of a pressure above or below ambient pressure inside the container when hot liquids are being contained. The vent also facilitates the mounting of the lid on the container by relieving the initial compression of the air trapped within the container due to sealing of the lid over and within the container.

A particularly bothersome problem arises with conventional vented lids sealed over beverage containers filled with a hot drink such as coffee or tea. When the sealed container is placed in a paper bag, one or more paper towels or napkins are often placed on the lid in expectation of leakage through the vent hole.

As the bag is carried about, the hot contents of the container are splashed around thereby causing some of the liquid to escape through the vent. Over time, the napkins or towels provided over the lid become saturated and liquid begins to flow to the bottom of the paper bag. If the bag becomes soggy, it can weaken and tear under the load of the liquid in the container.

The result is often a messy spill wherein the lid is forced off the container upon impact with the ground. Any other contents of the soggy bag are typically soaked and spoiled. In the case of a hot coffee spill, clothing, furniture, carpeting, car interiors and any other surrounding surface, may be stained. Moreover, hot coffee and the like can cause scalding as it is ejected out of the container upon impact.

Accordingly, a need exists for a vented container lid which allows for the venting of air into and out of a sealed container yet which prevents the leakage of liquids through the vent.

A further need exists for such a lid which is economical to produce so as to promote its disposability.

Another needs exists for a disposable vented container lid which is particularly adapted For sealing hot beverages within disposable containers such as Styrofoam and cardboard cups and which prevents the hot contents from escaping through a vent formed in the lid.

Still another need exists for such a vented lid which prevents leakage, scalding and staining by hot liquids stored in disposable beverage containers.

SUMMARY OF THE INVENTION

The present invention has been developed to fulfill the needs noted above and therefore has as an object the provision of a vented lid which allows for the venting of air to and from the interior of a container, yet which prevents the escape of liquids from the container.

Another object of the invention is the provision of a vented container lid which prevents the escape of hot liquids such as coffee and tea from a sealed container and thereby prevents burning and scalding of a user or anyone in the vicinity of the container.

Still another object of the invention is the provision of a simple and inexpensive filter membrane on the lid of a beverage container for inhibiting the flow of liquid through one or more vent holes formed in the lid.

Yet another object of the invention is the provision of a hydrophobic Filter which may be easily applied to virtually any existing container lid design.

Another object of the invention is the provision of a filter formed of polytetrafluoroethylene (PTFE) and mounted on one side of a container lid for allowing the flow of air into and out of a sealed container.

These and other objects are met by the present invention which is directed to a leak resistant or leakproof vented lid for a container. The lid is particularly intended for use with disposable beverage containers of the type used to hold cold soft drinks, as well as hot beverages such as coffee and tea. Another object of the invention is the provision of an inexpensive hydrophobic non-woven filter.

The vent formed in the lid is covered with a breathable membrane which freely allows the passage of gasses but inhibits or prevents the passage of liquids therethrough. The membrane or filter preferably comprised of a hydrophobic material having a predetermined pore size.

Microporous materials available under the brand names Gore-Tex, Tetratex and Micro-O have been Found suitable for use as a membrane material. These materials include polytetrafluoroethylene (PTFE) as a major constituent.

The membrane may be formed in virtually any manner such as blanking or cutting and may be shaped in virtually any configuration to fit over virtually any vent hole. For example, a precut circle or "coin" or a precut length of ribbon may be sealed on either the interior or exterior of a disposable plastic lid such as a vacuum formed styrene plastic lid.

The sealing of the membrane to the lid may be achieved by conventional heat sealing and ultrasonic welding methods or with conventional adhesives such as a glue applied as a hot melt or at room temperature. A seal and cut tool can also be used to seal the membrane in place on the lid and to simultaneously trim away any excess membrane material. This method is particularly suitable when the membrane material is dispensed in the form of a strip of ribbon from a roll.

The vent hole, which generally measures about 0.020 inch in diameter, is completely covered by the membrane on one side of the lid, that is, either on the interior or exterior side of the lid. The vent is generally formed during the molding of the lid by a simple puncture operation using a pointed punch.

The application of the membrane to the lid can be carried out after the molding of the lid from sheet plastic and either prior to or after the lids are individually die cut from a sheet.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

Detailed Description of the Preferred Embodiments

The present invention will now be described in conjunction with the drawings beginning with FIGS. 1 and 2 which show a lid assembly 10 constructed in accordance with a first embodiment of the invention. The general construction of lid assembly 10 includes a circular plastic cap 12 and a membrane 14 mounted on the cap.

Cap 12 may take the form of virtually any conventional cap of the type used to seal beverage containers and the like and may be produced using well known forming techniques. For example, cap 12 may be vacuum formed from a sheet of thermoplastic material such as styrene plastic.

Figure 2:
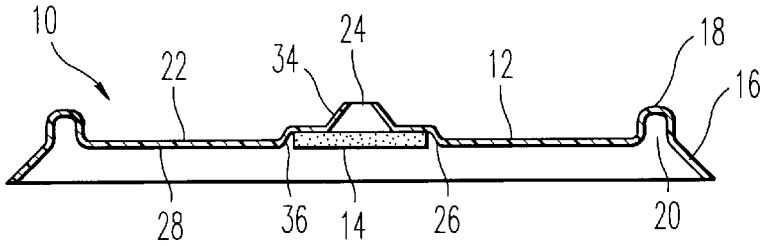
FIG. 2 is a central sectional view taken along section line 2—2 of FIG. 1.
Figure 1:
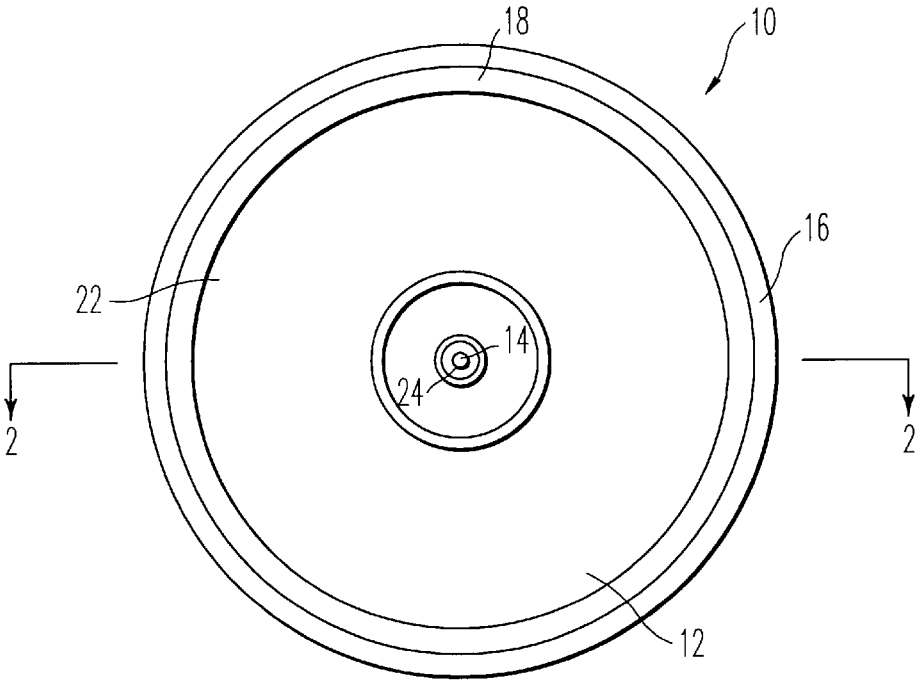
FIG. 1 is a top plan view of a first embodiment of a lid constructed in accordance with the invention.

As further seen in FIGS. 1 and 2, cap 12 includes an outwardly flared rim 16 for centering the lid over and around the top edge of a beverage container. Rim 16 joins an annular upstanding flange 18 which defines an interior U-shaped annular channel 20 around the periphery of the cap. Channel 20 receives the cylindrical top edge of a beverage container with a wedged interfit so as to provide a watertight seal between the cap and container.

An annular flat top portion 22 extends radially inwardly from the annular flange 18 to a hole or vent 24 formed through the center of the cap 12. A circular recess or pocket 26 is formed on the bottom surface or underside 28 of cap 12 for receiving and holding the membrane 14 in position around, over and across the vent 24.

Figure 3:
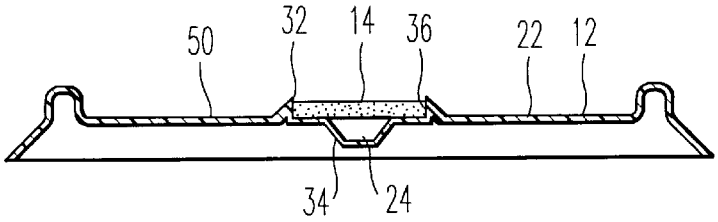
FIG. 3 is a view similar to FIG. 2 depicting an alternate embodiment of the invention.

As seen in FIG. 3, the membrane 14 may alternatively be mounted on the top surface 30 of top portion 22. A circular pocket 32 is formed during molding of cap 12 for receiving the membrane 14. It is preferable to have the conical or annular punctured sidewall 34 of vent 24 extend away from the membrane in each embodiment as seen in FIGS. 2 and 3 so as to facilitate the mounting of the membrane to the cap.

Membrane 14 acts as a selective filter which allows the flow of atmospheric air in either direction through vent 24 yet inhibits or prevents the flow of liquids through the vent. That is, the pore size of membrane 14 is selected to be large enough to pass atmospheric air yet small enough to block water molecules in the form of a liquid.

The size of membrane 14 may range from about 0.25 to 1.0 inch in diameter and may be precut from various commercially available hydrophobic microporous materials sold under such brand names as Gore-Tex, Tetratex and Micro-O. Although these materials are formed with polytetrafluoroethylene, any other porous filter membrane including other suitable polymers and paper or cellulose based materials may be used as long as they inhibit or prevent the passage of liquids and allow the passage of air therethrough. It is preferable that membrane 14 be non-absorbent so as not to absorb liquids and block the filter micropores.

Referring back to FIG. 2, filter membrane 14 may be secured within pocket 26 without adhesive with a simple press fit against the walls of the pocket either during or after thermoforming of cap 12. Alternatively, filter membrane 14 may be bonded within pocket 26 with a suitable adhesive or glue during or after thermoforming cap 12. The adhesive may be applied around the edge 36 of pocket 26 so as to avoid blocking the vent 24.

Alternate arrangements for securing the filter membrane 14 to cap 12 are shown in FIG. 4 through 8 wherein an adhesive or bonding agent is applied to or laminated with the filter membrane. This allows the construction of filter membrane 14 in the form of an easily applied "sticker" which may be applied in the manner of a gummed label.

Figure 5:
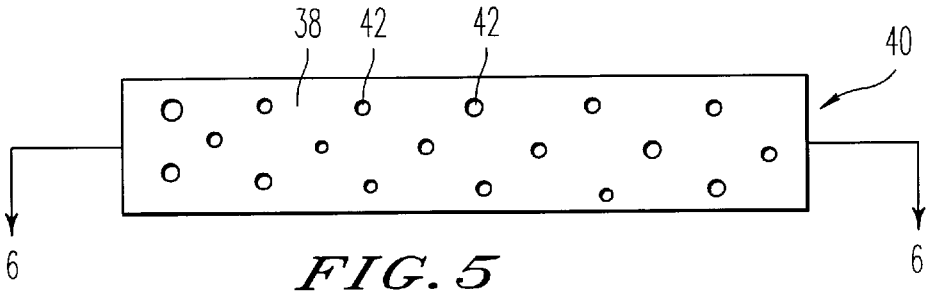
FIG. 5 is a top plan view of another embodiment of a filter membrane constructed in accordance with the invention.
Figure 6:
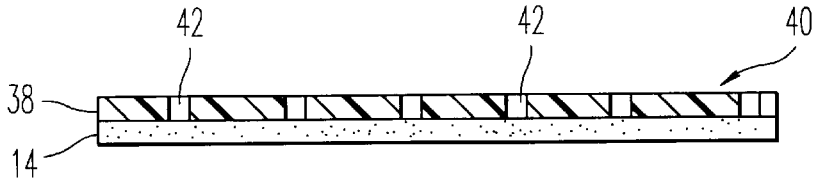
FIG. 6 is a view in section taken along section line 6—6 of FIG. 5.
Figure 4:
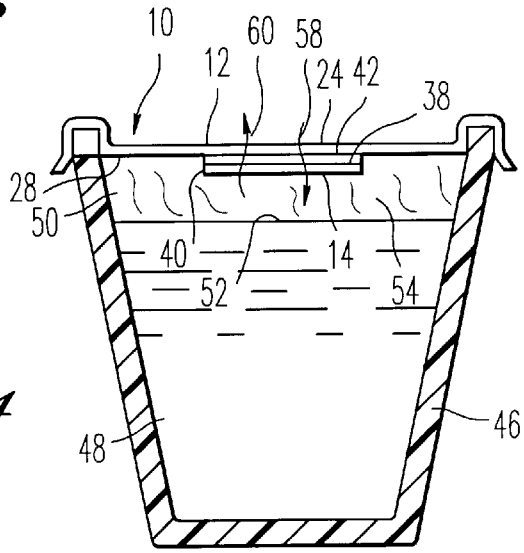
FIG. 4 is a central sectional view of a beverage container fitted with a lid constructed in accordance with another embodiment of the invention.

As seen in FIGS. 4, 5 and 6, a strip or ribbon of filter membrane 14 is laminated to a strip of adhesive 38 in the manner of a strip of adhesive tape 40. However, the adhesive strip 38 must be able to freely pass atmospheric air through it. This can be accomplished by providing perforations or breather holes 42 through the adhesive strip.

Figure 7:
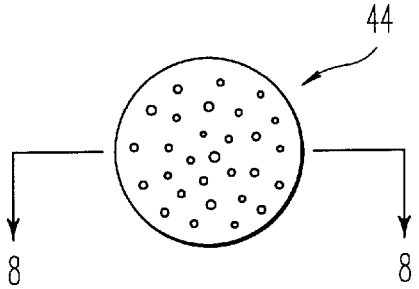
FIG. 7 is a top plan of another embodiment of a filter membrane constructed in accordance with yet another embodiment of the invention.
Figure 8:
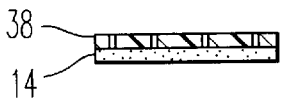
FIG. 8 is a view in section taken along section line 8—8 of FIG. 7.

Other adhesive patterns may be used such as a pair of thin parallel lines of adhesive applied along the sides of each filter membrane 14. Moreover, circular patches 44 as shown in FIG. 7 and 8 may be coined from strip 40 and pressed into position over vent 24. It is also possible to use a plastic material as the adhesive such as a heat bondable thermoplastic or thermosetting plastic.

FIG. 4 schematically shows a lid assembly 10 constructed with either a rectangular adhesive strip or circular patch 40,44 and fitted over a beverage container 46. Liquid 48 is shown held in the container 46 and defining a chamber 50 between the top surface 52 of the liquid and the underside 28 of cap 12.

In the case where liquid 48 is a hot beverage such as coffee, steam 54 may form in chamber 50. Membrane 14 prevents most or all of steam 54 from exiting through vent 24, yet allows atmospheric air 58 from outside container 46 to enter chamber 50 and allows hot atmospheric air 60 and steam 54 to escape chamber 50.

There has been disclosed heretofore the best embodiment of the invention presently contemplated. However, it is to be understood that various changes and modifications may be made thereto without departing from the spirit of the invention.

What is claimed is:

1. A lid assembly for a beverage container, comprising:

a thermoformed plastic press fit lid for creating a seal on a container;

a filter mounted on said lid, said filter comprising a hydrophobic filter material which allows the passage of air through said filter and which inhibits the passage of a beverage through said filter; and wherein said lid, when attached to a beverage container, allows passage of gases and prevents passage of the beverage.

2. The assembly of claim 1, wherein said filter material comprises a non-absorbent hydrophobic material.

3. The assembly of claim 1, wherein said filter material comprises polytetrafluoroethylene.

4. The combination of the lid assembly according to claim 1 and a beverage container, wherein said container has a conical shape having a base and a top, wherein said base is smaller than said top.

5. The assembly of claim 1, wherein said cap comprises a vent formed therethrough and wherein said filter is mounted over said vent.

6. The assembly of claim 1, wherein said filter is heat sealed to said cap.

7. The assembly of claim 1, wherein said filter is glued to said cap.

8. The assembly of claim 1, wherein said cap comprises a vent formed therethrough and a sidewall surrounding said vent and wherein said sidewall extends away from said filter.

9. The assembly of claim 1, further comprising a perforated adhesive connecting said filter to said cap.

10. The assembly according to claim 1, wherein said lid assembly is leak resistant, and said seal comprises a leak resistant seal.

11. The assembly according to claim 1, wherein said lid assembly is leak proof, and said seal comprises a watertight seal.

12. The assembly of claim 1, wherein said filter material comprises a non-absorbent non-woven hydrophobic material.

13. The assembly of claim 12, wherein said filter material comprises polyester.

14. The assembly of claim 12, wherein said filter material comprises polypropylene.

15. A lid assembly for a beverage container, comprising:

a thermoformed plastic press fit lid having a top portion surrounded by a U-shaped channel for forming a press fit seal on the beverage container, and a vent hole formed through said top portion; and a filter mounted on said lid and covering said vent hole, said filter comprising a hydrophobic material, said filter defining a plurality of micropores dimensioned to allow the passage of atmospheric air through said filter and to prevent the passage of liquid water through said filter; and wherein said lid, when attached to a beverage container, allows passage of gases and prevents passage of the beverage.

16. The assembly of claim 15, wherein said filter comprises a circular filter having a diameter ranging from 0.25 inch to 1 inch.

17. The assembly of claim 15, wherein said filter is heat sealed to said cap.

18. The assembly of claim 15, wherein said filter is mounted to said cap in the form of a strip.

19. The assembly of claim 15, wherein said cap comprises a circular cap having a circular recess formed therein and wherein said filter comprises a circular filter mounted within said circular recess.

20. The assembly of claim 15, wherein said filter comprises polytetrafluoroethylene.

21. The assembly of claim 15, wherein said filter is bonded to said cap.

22. The assembly according to claim 15, wherein said lid assembly is leak proof, and said seal comprises a watertight seal.

23. The assembly according to claim 15, wherein said lid assembly is leak resistant, and said seal comprises a leak resistant seal.

24. The assembly of claim 15, wherein said filter comprises a bonding layer and a filter layer.

25. The assembly of claim 24, wherein said bonding layer comprises an adhesive material.

26. The assembly of claim 24, wherein said bonding layer is perforated.

* * * * *